US005158479A

United States Patent [19]

Mouissie

[11] Patent Number: 5,158,479

[45] Date of Patent: Oct. 27, 1992

[54] CONNECTOR WITH A FLUID SEAL

[75] Inventor: Bob Mouissie, Berlicum, Netherlands

[73] Assignee: E. I. Du Pont de Nemours and Company, Wilmington, Del.

[21] Appl. No.: 647,642

[22] Filed: Jan. 29, 1991

[30] Foreign Application Priority Data

Jan. 30, 1990 [NL] Netherlands ..... 9000229

[51] Int. Cl.[5] ..... H01R 13/41; H01R 13/52

[52] U.S. Cl. ..... 439/589; 174/152 G; 439/466; 439/733; 439/869

[58] Field of Search ..... 439/278-282, 439/444, 586-589, 598, 599, 466, 733, 751, 901, 903, 736, 869, 870, 741, 84; 174/152 G, 65 R, 65 G, 65 SS; 411/451, 456, 455

[56] References Cited

U.S. PATENT DOCUMENTS

| | | | |
|---|---|---|---|
| 2,069,427 | 2/1937 | Stott | 439/870 |
| 2,945,203 | 7/1960 | Quackenbush | 439/589 |
| 3,193,895 | 7/1965 | Oxley | 24/73 |
| 3,214,713 | 10/1965 | Strobel | 439/418 |
| 3,398,391 | 8/1968 | Brishka | 439/751 |
| 3,792,416 | 2/1974 | Moulin . | |
| 3,867,001 | 2/1975 | Hedman | 439/281 |
| 4,717,354 | 1/1988 | McCleerey | 439/444 |
| 4,859,812 | 8/1988 | Klosin | 174/152 G |

FOREIGN PATENT DOCUMENTS

| | | | |
|---|---|---|---|
| 2643158 | 9/1977 | Fed. Rep. of Germany | 439/733 |
| 8609767 | 7/1986 | Fed. Rep. of Germany . | |
| 1060271 | 3/1967 | United Kingdom | 439/733 |

*Primary Examiner*—Neil Abrams

[57] ABSTRACT

A connector having a male part and a matching female part, both parts are provided with mating faces extending essentially parallel to the plug-in direction and moving along each other when these parts mate with each other. One connector part is provided with one or more radially projecting collars which are sawtooth-shaped in cross-section and extend over the entire periphery of the mating face. The other connector part has a smooth surface extending over the entire periphery of the fitting face so that after the parts are plugged in, the outside edge of each collar rests in sealing fashion on the opposite smooth fitting face. The male part can be a supporting body for the contact elements of the connector and/or a contact element itself. The female part can be the housing of the connector and/or an aperture in the supporting body for receiving a contact element.

5 Claims, 2 Drawing Sheets

CONNECTOR WITH A FLUID SEAL

BACKGROUND OF THE INVENTION

The present invention relates to a connector and more particularly to a connector with a fluid seal.

To provide a fluid seal between parts of an electrical connector, for example, between mated male and female parts, a tubular rubber or plastic sealing element is generally used. This tubular element is placed between the mating surfaces of the male and female connector parts.

SUMMARY OF THE INVENTION

The object of the present invention is to provide a reliable seal between the male and female parts of a connector without the need for a separate rubber or plastic sealing element. The sealing and locking means are combined and integral with the connector parts so that the number of parts of the connector can be reduced and mating of the connector parts can be simplified while providing an excellent fluid seal. The reduction of the number of parts makes it possible to produce the connector more cheaply and makes mating easier.

The foregoing objects are achieved according to the invention by providing at least one mating face of a connector part with one or more radially projecting collars which are sawtooth-shaped in cross-section and extend circumferentially over the entire periphery of the mating face. The opposite mating face of the other connector part has a smooth surface extending over the entire periphery. When the connector parts are plugged into each other, the outside edge of each collar penetrates the opposite smooth mating face to provide a good seal.

The outside edge of each collar preferably projects radially further inwards or outwards than the face of the opposite mating smooth face of the other connector part. The smooth mating face is consequently pressed in slightly by the outside edge of the collar and an excellent fluid seal is obtained. The outside edges must not, however, project so far that excessive deformation of the outside edge and/or of the opposite smooth mating face occurs. In general, the distance of projection of the outside edge of the collar past the plane of the surface opposite smooth mating face will depend on the sawtooth shape and on the materials from which the collars and the smooth mating faces are made.

The collars are preferably made of a harder material than the opposite smooth mating face. The collars can be made of, for example, metal and the smooth mating face of plastic. On mating, the hard collars deform the opposite smooth mating face slightly in such a way that grooves, running along the entire periphery, are produced in the smooth mating face, in which grooves the edges of the sawtooth-shaped collars rest. The concentration of the clamping stress between the connector parts in the grooves thus formed produces a very high pressure locally, which effectively counteracts the penetration of gases and liquids. The fact that the edges of the collars rest in the grooves formed by the clamping also means that a great resistance has to be overcome in order to move the collars relative to the clamping faces, so that accidental shifting of the connector parts relative to each other is virtually not possible. It will be clear that if a groove is provided beforehand for the sawtooth cutter edge, the clamping stress will be lower than when a groove is formed by pressing into the smooth mating face.

Insertion of the parts can be facilitated if the side of the sawtooth-shaped collars facing the plug-in direction of the part provided with collars has less of an inclination than the other side of the collars. For example, the flank at the plug-in direction of the sawtooth should stand at a slight angle relative to the mating face, for example at an angle of 15 to 45°.

In general, a permanent seal is desired since it is not necessary to disconnect the connector parts again. The sawtooth-shaped collars can advantageously be designed in such a way that the sides of the sawtooth-shaped collars facing away from the plug-in direction of the part provided with collars are fairly steep; for example at an angle of 60 to 90° relative to the mating face. It is, of course, also possible to make this angle greater than 90°, for example 100° or 120°, so that the side of the collars facing away from the plug-in direction slopes in the same direction as the other sides. The flanks of the sawtooth, either each individually or both, can also be made curved, for example in the form of a concave semi-circle.

Where several parallel collars are used, plugging-in of parts can be made even easier by varying the circumference of the collars in such a way that the collar which on insertion comes into contact first with the opposite mating face grips and penetrates less deeply into the smooth mating face than the following collar(s). Of course, both collars and smooth clamping faces can be formed on each connector part.

It is also possible to use the fluid-sealing means according to the invention for sealing between metal contact pins and/or sockets of an electric connector which are closed at one side and the connector body. The contact pins or contact sockets here form the male parts, and the plastic connector body forms the female part. In practice, contact pins are generally molded in during the manufacture of the connector body. Through temperature fluctuations and mechanical stresses in the connector, play can rise between the metal contact pins of the connector body, thereby causing the fluid seal to be lost. Where the fluid-sealing means according to the invention are used, the contact face of the collars and the opposite smooth fitting face are provided with a very good sealing clamping stress, which cannot be guaranteed when the pins are molded in. This also produces a better seal which is resistant to temperature fluctuations.

The invention will now be explained in greater detail with reference to an example of an embodiment shown in the drawings.

DETAILED DESCRIPTION OF THE EMBODIMENT

Figure 1:
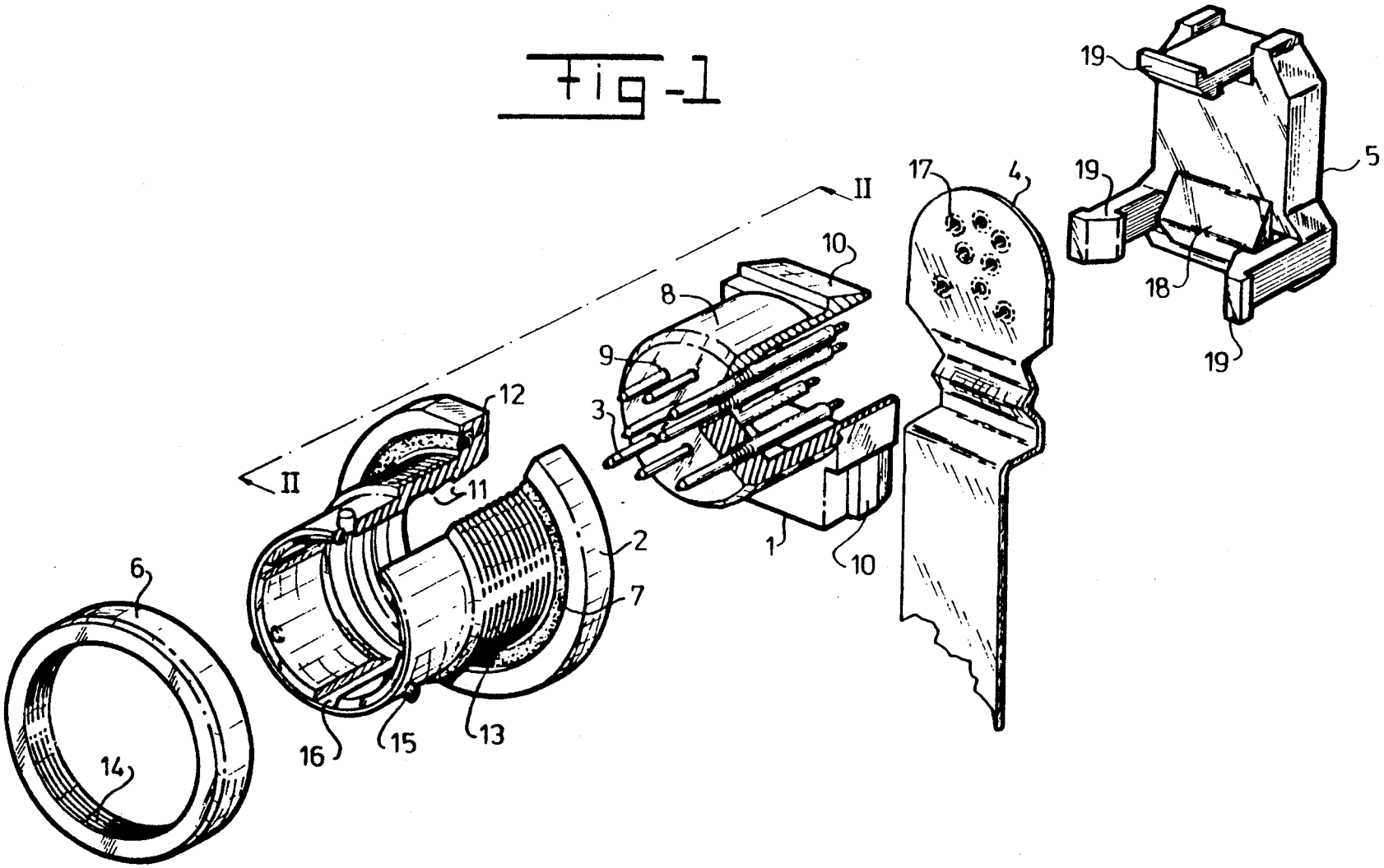
FIG. 1 is a view in perspective of a connector, provided with fluid-sealing means according to the invention, with the parts disassembled.

The connector according to FIG. 1 comprises a male connector part 1, a female connector part 2, contact pins 3, a flexible sheet 4, a cap 5, a locking ring 6 and an O-ring 7.

The male connector part 1 is provided with a smooth cylindrical mating face 8, for example in the form of a cylindrical body of revolution, for sliding into the connector part 2. Male part 1 has holes 9 to accommodate contact pins 3, and locking lobes 10 for securing the cap 5 in a locked position. In the preferred embodiment of the invention shown here, the male connector part 1 is made of plastic.

The female connector part 2 is preferably made of metal and as a cylindrical opening to receive the male connector part 1. The female connector part 2 is provided with sawtooth-shaped collars 11 running all the way around its internal periphery and projecting into the cylindrical opening. These collars mate with face 8 of part 1 to clamp the female connector part 2 onto the male connector part 1.

The collars 11 in the embodiment shown are integral with the mating face of the female connector part 2. Part 2 is also provided with a circular groove 12 to accommodate the O-ring 7, and with a screw thread 13 along its outer periphery for screwing on the locking ring 6. The ring 6 is provided with a screw thread 14. The female connector part 2 is further provided with lobes 15 and grooves 16 for connecting with another connector (not shown) in a locked manner. The O-ring 7, for example, is made of rubber or plastic. By mating with the locking ring 6, the O-ring 7 ensures that the connector is secured in a sealing manner to a mounting surface (not shown). Such a surface may be a metal or plastic plate provided with an aperture. The connector part 2 is plugged into the aperture where it is mounted on the plate. The diameter of the aperture must be approximately the same as the internal diameter of the O-ring 7 so that the aperture can be shut off by screwing on the locking ring 6 after the connector part 2 is inserted.

The flexible sheet 4 is flat cable which provides the electrical connection to an electrical device. Sheet 4 is provided with apertures 17 for accommodating and contacting the ends of the contact pins 3. When the unit is assembled, the sheet 4 lies clamped between a pull relief 18 of the cap 5 and a portion (not shown) of the male connector part 1 on which the pull relief 18 connects. The locking lobes 19 ensure that in the assembled state the cap 5 is fixed in a locked position on the male connector part 1.

Figure 2:
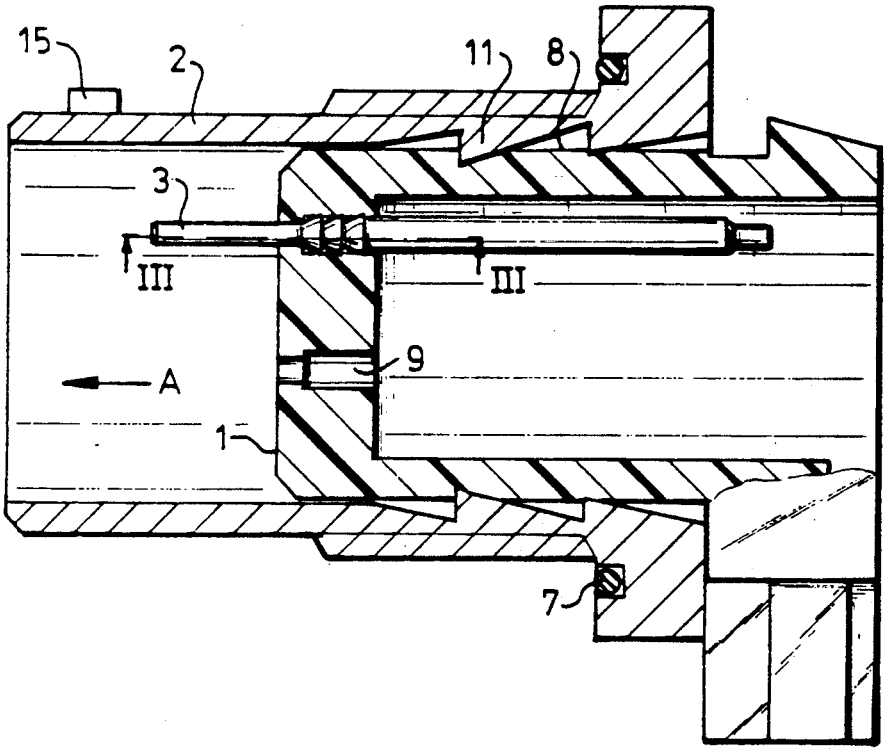
FIG. 2 is a cross-section drawing along the line II—II of the connector of FIG. 1.

FIG. 2 shows the way in which the male connector part 1 is inserted in a tight fitting manner into the female connector part 2, thereby providing also a good tight seal against gases and liquids. The connector part 1 is inserted in the plug-in direction A into the female connector part 2, until the sawtooth-shaped collars 11 engage with and penetrate the smooth, somewhat resilient mating face 8 of the male connector part 1. The collars 11 here penetrate a short distance into the mating face 8. In order to make the mating easier, the collars 11 in the embodiment shown are of different heights, with the height of each collar increasing in the plug-in direction A of the male connector part 1, so that the collar which first comes into contact with the opposite smooth mating face 8 will penetrate less into the mating face 8 than the next collar. This is shown in an exaggerated manner in FIG. 2, for the sake of clarity. The side of each collar 11 facing the male connector part 1 being inserted is less steep than the other side of the collar, which is very steep. As mentioned earlier, the side or flank of the collars facing the inserted part 1 may be of angle of 15° to 45° with the mating face while the other side should be at angle as steep as 60° to 90° or even larger, for example 100°.

Figure 3:
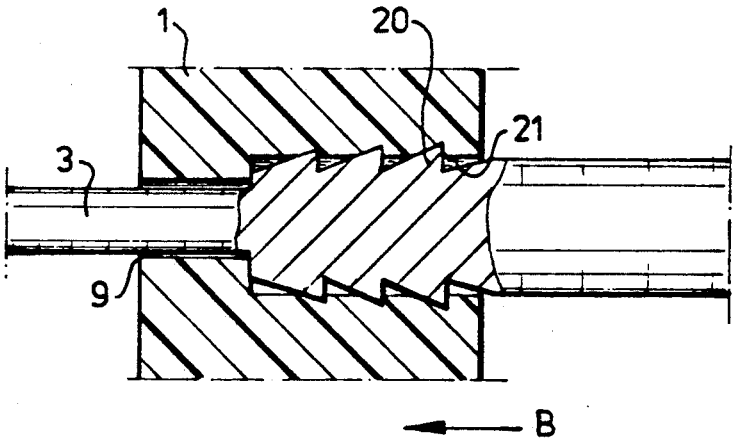
FIG. 3 is an enlarged partial cross-section of the connector body and a contact pin from FIG. 2.

FIG. 3 shows the way in which the metal contact pins 3 are fit tightly in the apertures 9 of the male connector part 1. The pin 3 inserted in the plug-in direction B has sawtooth-shaped collars 20 which engage with the smooth fitting face 21 of the aperture 9. The metal collars 20 here penetrate into the plastic fitting face 21, so that a good seal is produced. The insertion of the contact pins 3 can also be made easier by varying the diameter of the collars 20, as shown in FIG. 3. The height of the collars 20 decreases gradually in the plug-in direction B of the contact pin, so that the collar which on plugging-in first comes into contact with the opposite smooth fitting face 21 will penetrate less into the fitting face than the following collars. The last collar which comes into contact with the fitting face shown in the embodiment of FIG. 3 as the third collar, will deform the opposite fitting face 21 most. This is also shown in a slightly exaggerated manner in FIG. 3, for the sake of clarity. Through the use of at least two clamping collars, the contact pin is prevented from pivoting about a collar, which could lessen the sealing action.

Other embodiments of both the fluid-sealing elements and the connector are, of course, possible. For example, the male connector part 1 can also be provided with sawtooth-shaped collars on the outside, while the inside of the female connector housing 2 is smooth, or the connector part 1 and the connector a part 2 can both be provided with not only sawtooth-shaped collars, but also smooth fitting faces. The connector part 2 or the contact pins 3 can also be provided with more or differently shaped collars, or the collars can have the same circumference. It is also possible to fit a further connector tightly, also with fluid-sealing means according to the invention.

I claim:

1. A connector with fluid sealing between mated parts comprising:

a male connector part having a cylindrical body containing a plurality of contact pins, the outer peripheral surface of said cylindrical body forming a first mating face, a female connector part having a cylindrical opening and adapted to receive said male connector part within said opening, the inner peripheral surface of said female connector part defining said cylindrical opening forming a second mating face, and a plurality of radially projecting, annular sawtooth-shaped collars extending circumferential around the entire periphery of one of said first and second mating faces, the other of said first and second mating faces having a smooth surface, said collars formed of a material which is harder than the smooth surface of the other mating face, the first collar to contact the other mating face projecting a certain height from said one mating face and each successive annular sawtooth collar projecting a greater height from said one mating face than the previous, so that when the male connector part is inserted into the female connector part, the first mating face moves in adjacent contact along the second mating face and the harder sawtooth-shaped collars penetrate into the softer smooth surface of the other mating face to create a fluid seal between said male and female connector parts.

2. A connector according to claim 1 wherein the smooth surface of the said one mating face is made of plastic and each of the collars are made of metal.

3. A connector according to claim 1 wherein the angle between each sawtooth-shaped collar and said one mating face is steeper at forward side of the collar than at the rear side of said collar.

4. A connector according to claim 1 wherein in the male connector part is a plastic block.

5. A connector according to claim 4 wherein in the female connector part is a metal housing.

* * * * *